US008360175B2

(12) United States Patent
Fan et al.

(10) Patent No.: US 8,360,175 B2
(45) Date of Patent: Jan. 29, 2013

(54) CONVEX CRESTED INSERT WITH DEFLECTED WEDGE SURFACES

(75) Inventors: Xiaobing Fan, Hubei (CN); Peng Wu, Hubei (CN); Dongfang Chen, Hubei (CN); Chengfu Guo, Hubei (CN)

(73) Assignee: Kingdream Public Ltd. Co., Hubei (CN)

( * ) Notice: Subject to any disclaimer, the term of this patent is extended or adjusted under 35 U.S.C. 154(b) by 247 days.

(21) Appl. No.: 12/789,132

(22) Filed: May 27, 2010

(65) Prior Publication Data

US 2010/0300766 A1 Dec. 2, 2010

(30) Foreign Application Priority Data

May 27, 2009 (CN) ..... 2009 1 0062267

(51) Int. Cl.
*E21B 10/16* (2006.01)

(52) U.S. Cl. ..... 175/430; 175/432

(58) Field of Classification Search ..... 175/428, 175/430, 432

See application file for complete search history.

(56) References Cited

U.S. PATENT DOCUMENTS 5,421,424 A * 6/1995 Portwood et al. ..... 175/374
8,028,773 B2 * 10/2011 Singh et al. ..... 175/430

* cited by examiner

*Primary Examiner* — William P Neuder
(74) *Attorney, Agent, or Firm* — Fish & Richardson P.C.

(57) ABSTRACT

This invention relates to carbide inserts used on roller cone bits for oil and gas drilling applications as well as for other geological drilling applications, and more specifically, relates to the convex crested insert with deflected wedge surfaces. The insert comprises a cylindrical portion and a crest portion. Said crest portion is composed of a conical crest base, a top surface and two opposing wedge surfaces. Upper ends of the two wedge surfaces are merged smoothly with top surface of the insert. The specific feature of the structure is that top surface of the crest portion is convexed outwardly and forms a smooth curve surface which is higher in the middle and lowers down gradually to each end. Said two wedge surfaces are slant wedge surfaces, so that a width of the top surface and therefore a width of the insert crest are tapered from one end to the other. Advantages of this invention include: 1. Help for rock breaking and therefore, it can increase drilling efficiency of the cutters and lower the overall drilling cost; 2. higher anti-breakage capability and longer working life; and 3. when inserts of this invention are used as heel row cutting elements on bit, contact area between wider end of the top surface of the insert and borehole wall is larger and therefore the gouging action applied on the borehole wall is higher and can also achieve better gage protection of the bit.

12 Claims, 3 Drawing Sheets

CONVEX CRESTED INSERT WITH DEFLECTED WEDGE SURFACES

CROSS REFERENCE TO RELATED APPLICATIONS

Pursuant to 35 USC §119, this application claims the benefit of Chinese Patent Application No. 200910062267.2 filed May 27, 2009. The above application is incorporated by reference in its entirety.

TECHNICAL FIELD

This invention relates to a carbide insert used on roller cone bits for oil and gas drilling applications as well as for other geological drilling applications, and more specifically, relates to a convex crested insert with deflected wedge surfaces.

BACKGROUND OF THE INVENTION

Roller cone bits are widely used in oil and gas, mining and engineering drilling applications. During drilling, heel row cutters on cones of the bit undertake multiple jobs including break bottom hole rocks by impact actions, gouge borehole wall and help to maintain bit diameter in order to prevent bit diameter shrinkage. Breaking bottom hole rocks by impact actions requires sharper top surface of the insert; gouging borehole wall and maintaining bit diameter require larger contact area between heel row cutter and borehole wall. Heel row cutters normally used on roller cone bits of prior art include inserts with deflected wedge surfaces and conical spherical inserts, which can not meet the two requirements mentioned above simultaneously. Inserts with deflected wedge surfaces has a larger contact area with borehole wall and is helpful for gouging borehole wall and maintaining bit diameter. But this insert has a blunter top surface because there is a plain on the top surface of the insert, and so it is not beneficial to breaking bottom hole rocks by impact actions. When inserts with deflected wedge surfaces are used as heel row cutters on roller cone bit, heel row cutters become one of the main causes to the low rate of penetration. Although conical spherical insert has a sharper top surface and helpful for breaking bottom hole rocks by impact actions, the contact area between heel row cutters and borehole wall become smaller when conical spherical inserts are used as heel row cutters on bit, therefore causing weaker gouging actions to borehole wall and lower gage protection ability of the bit.

SUMMARY OF THE INVENTION

In accordance with teachings of the present disclosure, this invention is intended to provide a convex crested insert with deflected wedge surfaces that solves the deficiency of the inserts of prior art and can drill bottom hole rocks and gouge the borehole wall simultaneously and efficiently.

According to the present invention, there is provided a convex crested insert with deflected wedge surfaces comprising: a cylindrical portion and a crest portion, said crest portion is composed of a conical crest base, a top surface and two opposing wedge surfaces; upper ends of the two wedge surfaces are merged with the top surface of the crest portion; wherein the top surface is convexed outwardly and forms a smooth curve surface which is higher in the middle and lowers down gradually to each end; and a width of the top surface and therefore a width of the insert crest are tapered from one end to the other.

In accordance with one aspect of the invention, the two wedge surfaces are formed by intersections between rotating curved surfaces formed by their respective generatrix rotating around their respective rotating axes and the conical crest base; said two generatrixes and their respective rotating axes being located in two planes, said two planes forming two included angles with a center plane of the insert crest that passes the axis of the cylindrical portion of the insert, the two included angles being in the range of 45° to 89°.

In accordance with one aspect of the invention, said two generatrixes in said two planes are straight lines that are slanted from the axis of the cylindrical portion of the insert, and the included angles formed by said slanted straight lines and the axis of the cylindrical portion of the insert is larger than the included angles formed by said generatrix of the conical crest base and the axis of the cylindrical portion of the insert and is normally in the range of 25° to 50°.

In accordance with one aspect of the invention, said top surface of the insert is formed by a spatial curved surface cutting through the conical crest base, and the spatial curved surface is formed by three lateral curves and three transverse curves.

In accordance with one aspect of the invention, the middle curve of the said three lateral curves is a lateral curve that is convex upwardly, the other two lateral curves are arcs formed by loci of respective ends of the generatrix of the two wedge surfaces rotating around its rotational axes.

In accordance with one aspect of the invention, said middle lateral curve that is convex upwardly is formed by one arc or multiple arcs connected together, or by parabola, or by parabola and arc connected to each other.

In accordance with one aspect of the invention, said three transverse curves are all arcs, and their curvature radii R1, R2 and R3 are all different, and the curvature radii of the said transverse curves is descending from wider end to narrow end of the insert crest along the lateral curve, i.e., R1>R2>R3.

In accordance with one aspect of the invention, heights of the said three transverse curves relative to a bottom side of the crest base is different, and the transverse curve near the center of the top surface of the insert is higher, while the transverse curves near the ends of the top surface of the insert are lower.

In accordance with one aspect of the invention, height difference between the transverse curve near the center of the top surface of the insert and the transverse curves near ends of the top surface of the insert is 0.1 to 10 mm.

In accordance with one aspect of the invention, the two included angles B1 and B2 are ranged from 70° to 85°.

Technical benefits of the present invention include: 1. When the insert of this invention is used as heel row cutter on bit, the middle uppermost portion of the top surface of the insert contact formation rock first, and then ends of the insert crest contact the formation rock gradually. Therefore, contact area between the insert and formation rock is very small at the very beginning, so the partial contact stress applied on the rock is higher and this could be beneficial for rock breaking and thus increasing drilling efficiency of the insert and reducing overall drilling costs. 2. Because the top surface of the insert is higher in the middle and lower at both sides, the high stress normally encountered with conventional insert at both sides of the insert due to edge effect is effectively reduced, and therefore, rate of breakage at sides of the top surface of the insert is greatly reduced and working life of the insert is improved. 3. Due to smooth merge between top surface of the insert and other adjacent curved surfaces of the insert crest, stress concentration at connecting points is eliminated and rate of breakage at connecting points between top surface of the insert and other adjacent curved surfaces of the insert crest is decreased and this further improved the working life of the insert. 4. Because one end of the top surface of the insert is wider and the other end is narrower, it can be arranged so that the wider end of the top surface facing borehole wall when the insert of this invention is used as heel row insert, so that larger contact area between insert and borehole wall can be achieved which results higher gouging action against borehole wall and better gage protection of the bit.

DETAILED DESCRIPTION OF THE PREFERRED EMBODIMENTS

Preferred embodiments of the invention and its advantages are best understood by reference to FIGS. 1-9 wherein like number refer to the same and like parts.

A convex crested insert with deflected wedge surfaces is disclosed which comprises a cylindrical portion 1 and a crest portion 2. The crest portion is further composed of a conical crest base 8, a top surface 3 and two opposing wedge surfaces 7*a*, 7*b*. An included angle between a generatrix of the crest base 8 and an axis of the cylindrical portion of the insert is 20°, and upper edges of the two wedge surfaces are merged with the top surface 3 of the insert.

Figure 4:
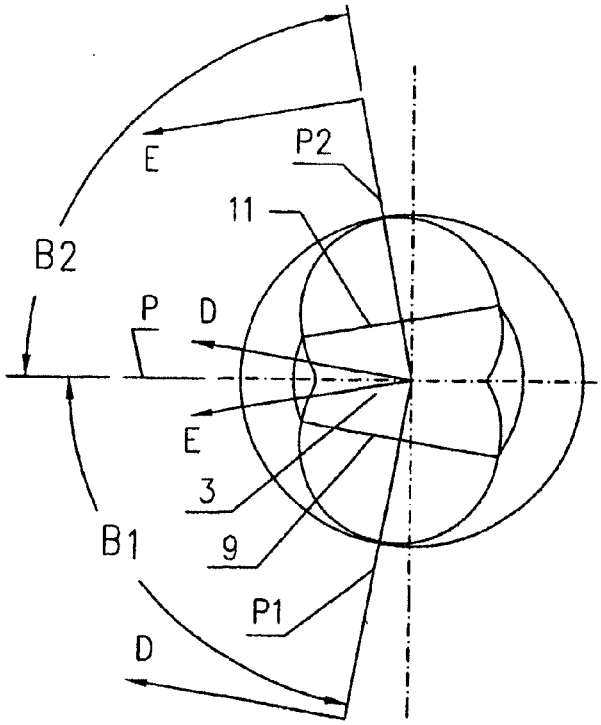
FIG. 4 is a top view of FIG. 1.

FIG. 4 shows three imaginary planes P, P1, P2 passing through the axis of the cylindrical portion of the insert, with two included angles B1, B2 formed between the plane P as a center plane of the insert crest and two lateral planes P1, P2. The two included angles B1, B2 might be ranged from 45° to 89°, and preferably from 70° to 85°.

Figure 5:
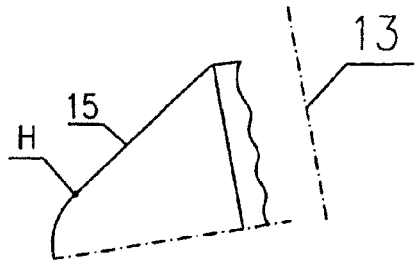
FIG. 5 is a partial sectional view taken along line E-E in FIG. 4.
Figure 6:
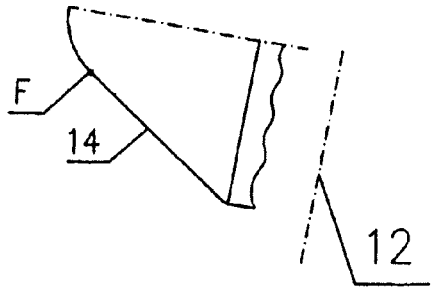
FIG. 6 is a partial sectional view taken along line D-D in FIG. 4.
Figure 7:
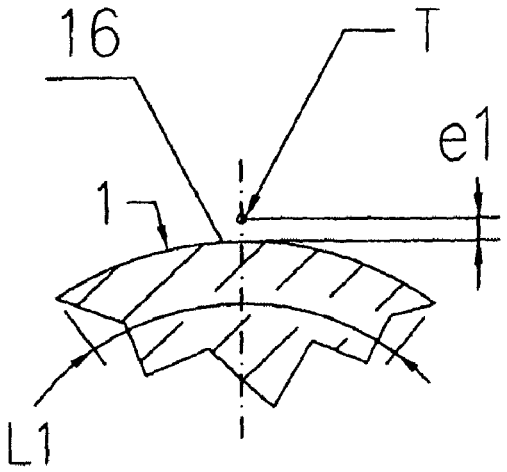
FIG. 7 is a partial sectional view taken along line A-A in FIG. 1.
Figure 8:
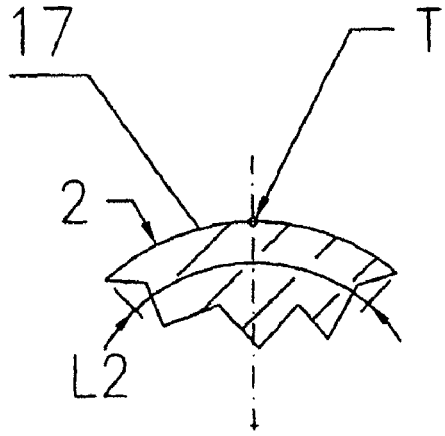
FIG. 8 is a partial sectional view taken along line B-B in FIG. 1.
Figure 9:
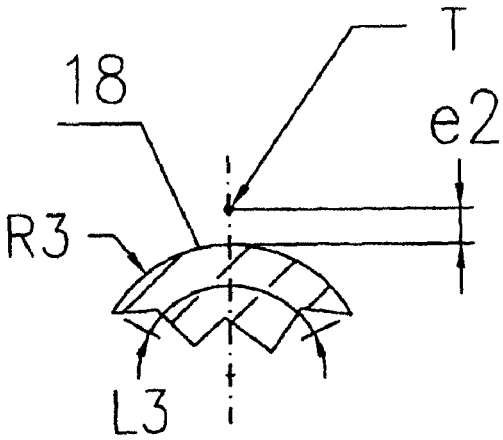
FIG. 9 is a partial sectional view taken along line C-C in FIG. 1.

The two wedge surfaces 7*a* and 7*b* might be defined or formed in a manner as described hereinafter. As shown in FIGS. 5 and 6, a straight line 14 and a rotational axis 12 are drawn within the plane P1. The rotational axis 12 is underneath the insert crest and perpendicular to axis of the cylindrical portion of the insert. Distance from the rotational axis 12 to the highest point of the insert crest might be in the range of 2 to 40 mm. The straight line 14 is in angular relationship with the axis of the cylindrical portion of the insert and the included angle therebetween is larger than the one formed by the generatrix of the crest base 8 and the axis of the cylindrical portion of the insert, possibly in the range of 25° to 50°, and preferably of 30° to 40°. An intersection between a curved surface formed by the straight line 14 as a generatrix rotating around the rotational axis 12 and the conical crest base 8 constitutes the wedge surface 7*a*. When rotating the straight line 14 around the rotational axis 12, a locus of an upper end point F of the straight line 14 constitutes a lateral curve 9 of the top surface of the insert. Similarly, a straight line 15 and a rotational axis 13 are drawn within the plane P2. The rotational axis 13 is underneath the insert crest and perpendicular to axis of the cylindrical portion of the insert. Distance from the rotational axis 13 to the highest point of the insert crest might be in the range of 2 to 40 mm. The straight line 15 is in angular relationship with the axis of the cylindrical portion of the insert and the included angle therebetween is larger than the one formed by the generatrix of the crest base 8 and the axis of the cylindrical portion of the insert, possibly in the range of 30° to 40°. An intersection between a curved surface formed by the straight line 15 as a generatrix rotating around the rotational axis 13 and the conical crest base 8 constitutes the wedge surface 7*b*. When rotating the straight line 15 around the rotational axis 13, a locus of an upper end point H of the straight line 15 constitutes a further lateral curve 11 of the top surface of the insert. The two wedge surfaces 7*a* and 7*b* form two deflected wedge surfaces so that a width of the top surface and therefore a width of the insert crest are tapered from one end to the other.

Figure 1:
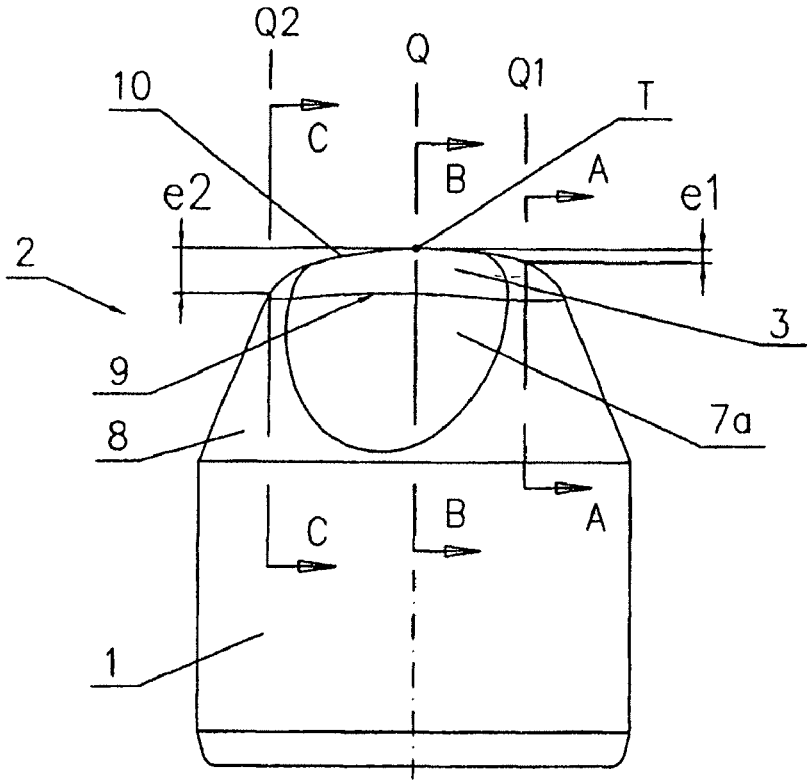
FIG. 1 is a front view of an insert according to an embodiment of the present invention.
Figure 2:
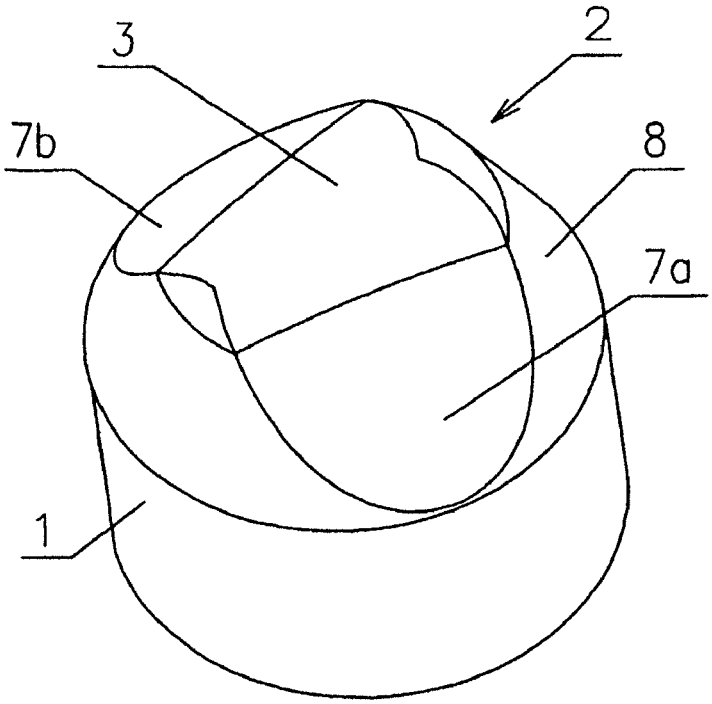
FIG. 2 is a perspective view of the insert according to the embodiment of the present invention.
Figure 3:
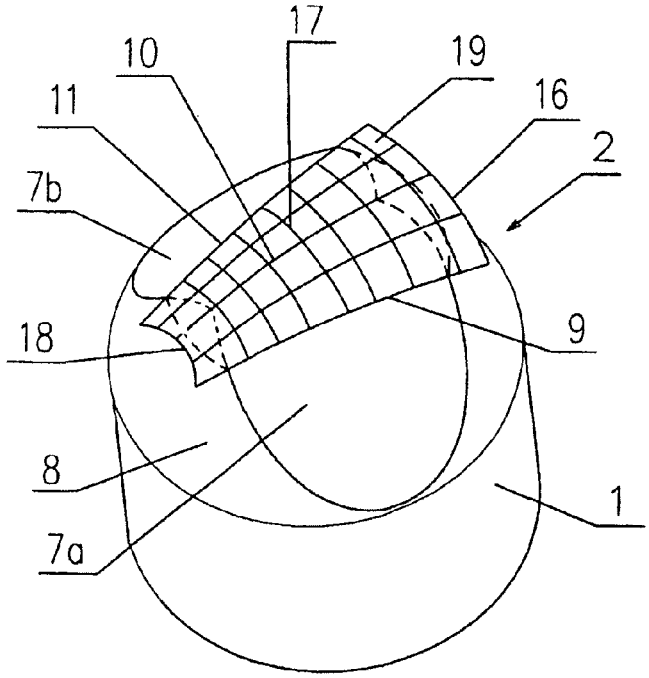
FIG. 3 is a structural schematic perspective view of a top surface of the insert according to the embodiment of the present invention.

As shown in FIG. 3, an upwardly convex curve is drawn in the center plane P of the insert crest as a middle curve 10. The middle curve 10 that is convex upwardly might be formed by one arc or multiple arcs connected together, or by parabola, or by parabola and arc connected to each other. The two lateral curves 9, 11 and the middle curve 10 serve as the curves that form a spatial curved surface 19 which will be described hereinafter. Within three imaginary vertical planes Q1, Q, Q2 that are perpendicular to the center plane P of the insert crest, three respective arcs are drawn as three transverse curves 16, 17, 18, in which the plane Q1 is at the wider end of the top surface of the insert, the plane Q passes through the axis of the cylindrical portion of the insert, and the plane Q2 is at the narrower end of the top surface of the insert. Radii of the three arcs are R1, R2 and R3 respectively, Length of the three arcs are L1, L2 and L3 respectively, and the relationships between them are R1>R2>R3 and L1>L2>L3. Heights of the three transverse curves 16, 17, 18 relative to a bottom side of the crest base are different. The transverse curve 17 near the center of the top surface of the insert is higher, while the transverse curves 16, 18 near the ends of the top surface of the insert are lower. Height differences between the transverse curve 17 near the center of the top surface of the insert and the transverse curves near ends of the top surface of the insert (i.e., e1 and e2) is 1 to 5 mm.

A smooth spatial curved surface 19 is formed via three lateral curves 9, 10, 11 and three transverse curves 16, 17, 18. A smooth top surface 3 that is convex outwardly, higher in the middle and lowers down gradually toward both ends is obtained by cutting through the crest base 8 with the spatial curved surface 19. A width of the top surface and therefore a width of the insert crest are tapered from one end to the other, and the top surface 3 is merged smoothly with the two wedge surfaces 7*a*, 7*b* and also with all other adjacent surfaces of the insert crest.

The invention claimed is:

1. A convex crested insert with deflected wedge surfaces comprising:

a cylindrical portion and a crest portion, said crest portion is composed of a conical crest base, a top surface and two opposing wedge surfaces; upper ends of the two wedge surfaces are merged with the top surface of the crest portion; wherein the top surface is convexed outwardly and forms a smooth curve surface which is higher in the middle and lowers down gradually to each end; and a width of the top surface and therefore a width of the insert crest are tapered from one end to the other.

2. The convex crested insert with deflected wedge surfaces of claim 1, wherein the two wedge surfaces are formed by intersections between rotating curved surfaces formed by their respective generatrix rotating around their respective rotating axes and the conical crest base; said two generatrixes and their respective rotating axes being located in two planes (P1, P2), said two planes (P1, P2) forming two included angles (B1, B2) with a center plane (P) of the insert crest that passes the axis of the cylindrical portion of the insert, the two included angles (B1, B2) being in the range of 45° to 89°.

3. The convex crested insert with deflected wedge surfaces of claim 2, wherein said two generatrixes in said two planes (P1, P2) are straight lines that are slanted from the axis of the cylindrical portion of the insert, and the included angles formed by said slanted straight lines and the axis of the cylindrical portion of the insert is larger than the included angles formed by said generatrix of the conical crest base and the axis of the cylindrical portion of the insert and is normally in the range of 25° to 50°.

4. The convex crested insert with deflected wedge surfaces of claim 1, wherein said top surface of the insert is formed by a spatial curved surface cutting through the conical crest base, and the spatial curved surface is formed by three lateral curves and three transverse curves.

5. The convex crested insert with deflected wedge surfaces of claim 4, wherein the middle curve of the said three lateral curves is a lateral curve (10) that is convex upwardly, the other two lateral curves are arcs formed by loci of respective ends of the generatrix of the two wedge surfaces rotating around its rotational axes.

6. The convex crested insert with deflected wedge surfaces of claim 5, wherein said middle lateral curve that is convex upwardly is formed by one arc or multiple arcs connected together, or by parabola, or by parabola and arc connected to each other.

7. The convex crested insert with deflected wedge surfaces of claim 4, wherein said three transverse curves are all arcs, and their curvature radii R1, R2 and R3 are all different, and the curvature radii of the said transverse curves is descending from wider end to narrow end of the insert crest along the lateral curve, i.e., R1>R2>R3.

8. The convex crested insert with deflected wedge surfaces of claim 7, wherein heights of the said three transverse curves relative to a bottom side of the crest base is different, and the transverse curve near the center of the top surface of the insert is higher, while the transverse curves near the ends of the top surface of the insert are lower.

9. The convex crested insert with deflected wedge surfaces of claim 8, wherein height difference (e1, e2) between the transverse curve near the center of the top surface of the insert and the transverse curves near ends of the top surface of the insert is 0.1 to 10 mm.

10. The convex crested insert with deflected wedge surfaces of claim 2, wherein the two included angles B1 and B2 are ranged from 70° to 85°.

11. The convex crested insert with deflected wedge surfaces of claim 2, wherein said top surface of the insert is formed by a spatial curved surface cutting through the conical crest base, and the spatial curved surface is formed by three lateral curves and three transverse curves.

12. The convex crested insert with deflected wedge surfaces of claim 1, wherein the width of the top surface and the width of the insert crest decrease from one end to the other.

* * * * *